US005305911A

United States Patent [19]

Aylward

[11] Patent Number: 5,305,911

[45] Date of Patent: Apr. 26, 1994

[54] FACETED CONTAINER

[75] Inventor: Thomas J. Aylward, Sandusky, Ohio

[73] Assignee: Sandusky Plastics, Inc., Sandusky, Ohio

[21] Appl. No.: 961,492

[22] Filed: Oct. 16, 1992

[51] Int. Cl.[5] ..... B65D 21/00

[52] U.S. Cl. ..... 220/675; 229/1.5 B

[58] Field of Search ..... 220/669, 674, 675; 229/1.5 B; 215/1 C; D7/523, 527, 531, 584

[56] References Cited

U.S. PATENT DOCUMENTS

| | | | |
|---|---|---|---|
| D. 37,604 | 10/1905 | Fletcher . | |
| D. 47,684 | 8/1915 | Blaze | D7/527 |
| D. 47,721 | 8/1915 | Haley . | |
| D. 72,639 | 5/1927 | Schmidt | D7/527 |
| D. 73,054 | 7/1927 | Schmidt | D7/527 |
| D. 201,400 | 6/1965 | Kneeland | D58/17 |
| D. 295,480 | 5/1988 | Pomroy | D7/527 |
| D. 299,298 | 1/1989 | Durand | D7/527 |
| 3,070,275 | 12/1962 | Bostrom | 229/1.5 B |
| 3,169,688 | 2/1965 | Schad | 229/1.5 B |
| 3,169,689 | 2/1965 | Schwartz | 229/1.5 B |
| 3,194,468 | 7/1965 | Baron | 220/675 X |
| 3,303,964 | 2/1967 | Luker | 220/675 X |
| 3,501,256 | 3/1970 | Milliken | 215/1 C X |
| 4,753,351 | 6/1988 | Guillen | 206/520 |

*Primary Examiner*—Steven M. Pollard
*Attorney, Agent, or Firm*—Watts, Hoffmann, Fisher & Heinke

[57] ABSTRACT

An injection molded container having a generally circular bottom panel, a side wall extending from the bottom panel, and lid receiving lip structure extending about the projecting wall end defining a container end opening opposite the bottom panel. The side wall extends about a central axis through the bottom panel and end opening. The side wall comprises a continuous outer wall face intersecting a plane extending normal to the axis along a substantially circularly curved line and an inner wall surface defined by a series of facets. The inner wall face intersects the plane along a line having a substantially polygonal shape composed of straight line segments corresponding to respective facets with each straight line segment extending tangent to a second substantially circular line within the first circular line. The side wall defines a series of spaced load supporting ribs each defined between a facet and the outer face. Each rib has a maximal thickness equal to the radial distance between the first and second circularly curved lines proceeding from the center of the panel. The side wall has a series of thin walled segments each having a minimal thickness along a radial line extending medially between adjacent ends of adjacent straight line segments. The maximal thickness rib has sufficient cross sectional area to assure injection molding material flow from the bottom panel area to the lip structure and sufficient column strength to enable mechanical capping of the container. The thin walled segments are narrow and just thick enough to effectively resist radially inward deformation when the container wall is supported internally during printing.

2 Claims, 4 Drawing Sheets

FACETED CONTAINER

FIELD OF THE INVENTION

The present invention relates to containers and more particularly to injection molded plastic containers usable to package comestibles for retail sale and which are so constructed and arranged that they are molded at minimal cost, are extremely light for their size and have adequate strength for use in printing and packaging equipment.

BACKGROUND OF THE INVENTION

Food processors using plastic containers for packaging foodstuffs such as cottage cheese, butter, etc. have traditionally used containers and lids made from thermoformed plastic materials. Thermoformed plastic packaging materials have been relatively inexpensive to packagers in terms of both low purchase prices and their light weight which minimized shipping costs. Thermoforming procedures have been performed using thin structurally strong plastic sheets which are formed at high speed over a large number of dies to simultaneously produce container components at high production rates.

Injection molded plastic packaging has been available but has not been a cost effective alternative to thermoformed elements. Recent advances in injection molding technology have made packaging produced this way economically competitive with thermoformed packaging. In particular, it has become possible to injection mold containers in multicavity molds at production rates which are highly competitive with the thermoformed products To enable the high production rates it is essential that the product design facilitate high injection flow rates simultaneously into multiple mold cavities e.g. "shooting" the plastic into a sixteen cavity mold in less than one second.

Because the improved technology has made injection molded packages relatively inexpensive, processors have begun to specify these containers and lids. A prerequisite of these containers is that they must be designed so that they can be accepted by existing packaging machinery which, in many cases, has been specifically constructed for handling thermoformed containers.

Plastic container forming materials lending themselves to injection molding processes tend to be relatively pliant, or easily flexed Great structural strength and rigidity is thus not a prime attribute of these injection molded containers. Accordingly such containers and lids must employ relatively heavy wall thicknesses where strength and rigidity are required At the same time the containers must be as light as possible to minimize both shipping and material costs.

The requirement for interchangeability with existing container manufacturing and packaging machinery is particularly critical. In the case of containers manufactured for packaging retail consumer products (e.g. dairy products) the containers are typically printed with labeling and brand information as they are being manufactured Printing requires container surfaces which readily accept printed indicia. Further, the container walls must coact with existing container printing equipment so that high quality images can be consistently transferred to the containers. If the container wall is deflected away from the indicia printing member at the time when an image is to be transferred the printed image is discontinuous or of varying density. Prior art containers employing variable thickness sidewalls have experienced image problems of this kind which result in unsightly packages.

After filling the container with such a product it is hermetically closed by a removable lid. This operation takes place in capping machinery. The capping machinery forces each lid onto a container and in so doing subjects the container to crushing forces These forces tend to collapse and buckle the container side wall inwardly. This action, while not usually sufficient to hole the side wall, tends to spew the contents into the machinery and/or to prevent establishing an effective seal between the lid and the container.

Because the containers are not extremely tall and the contents are not maintained under superatmospheric pressure the maximum bursting pressure exerted on the sidewall is slight. The container side wall thickness need only be minimal to resist bursting forces, yet the side wall must have "column" strength to resist the capping forces.

The disparate requirements of the injection molded containers have tended to result in containers which are heavier and more expensive than actually required for packaging.

The present invention provides a new and improved injection molded plastic container which is produced efficiently and inexpensively, uses minimal material so that its weight and material cost are minimized yet which provides relatively great column strength to resist crushing and permit efficient image transfers during printing.

SUMMARY OF THE INVENTION

The present invention provides a new and improved injection molded container having a generally circular bottom panel, a side wall extending from the bottom panel, and lid receiving lip structure extending about the projecting wall end defining a container end opening opposite the bottom panel. The side wall extends about a central axis through the bottom panel and end opening The side wall comprises a continuous outer wall face intersecting a plane extending normal to the axis along a substantially circularly curved line and an inner wall surface defined by a series of facets. The inner wall face intersects the plane along a line having a substantially polygonal shape composed of straight line segments corresponding to respective facets with each straight line segment extending tangent to a second substantially circular line within the first circular line. The side wall defines a series of spaced load supporting ribs each defined between a facet and the outer face. Each rib has a maximal thickness equal to the radial distance between the first and second circularly curved lines proceeding from the center of the panel. The side wall has a series of thin walled segments each having a minimal thickness along a radial line extending medially between adjacent ends of adjacent straight line segments. The maximal thickness rib has sufficient cross sectional area to assure injection molding material flow from the bottom panel area to the lip structure and sufficient column strength to enable mechanical capping of the container. The thin walled segments are narrow and just thick enough to effectively resist radially inward deformation when the container wall is supported internally during printing.

Other features and advantages of the invention will become apparent from the following detailed description of a preferred embodiment made with reference to the accompanying drawings which form part of the specification.

DESCRIPTION OF THE BEST KNOWN MODE OF PRACTICING THE INVENTION

Figure 1:
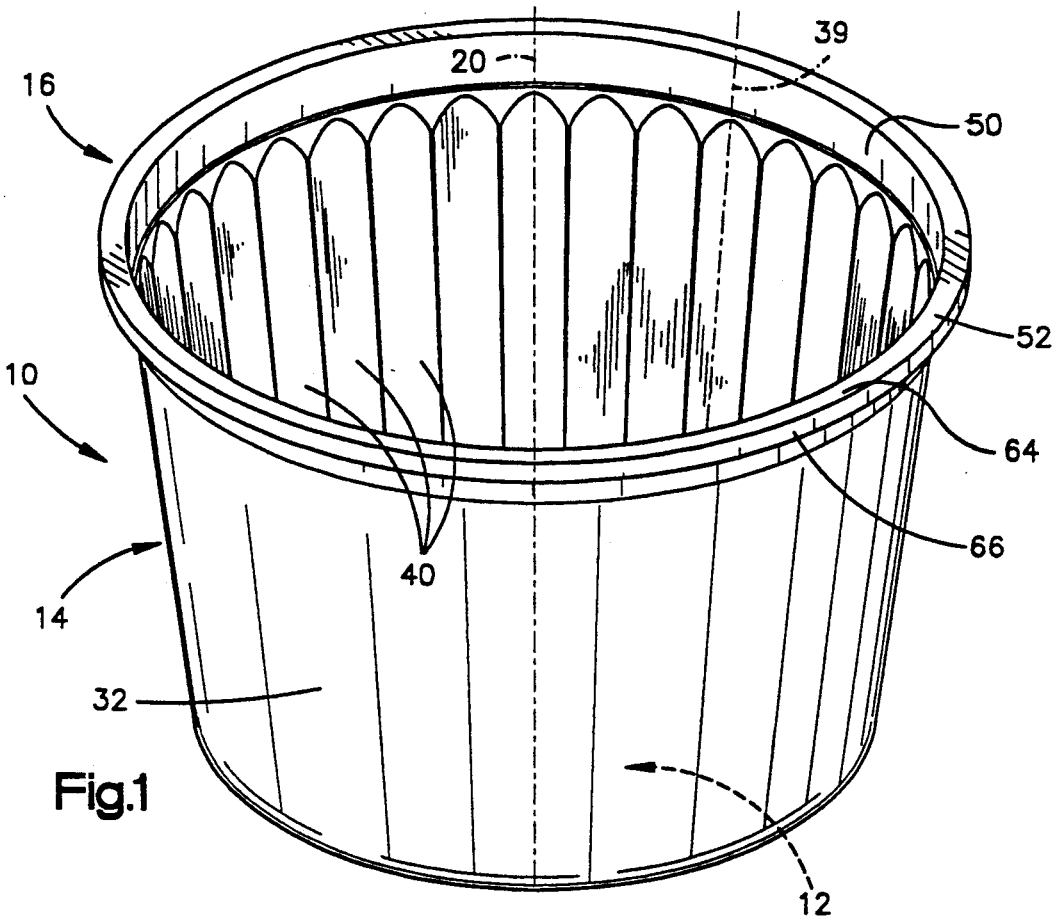
FIG. 1 is a perspective view of a container constructed according to the present invention.
Figure 2:
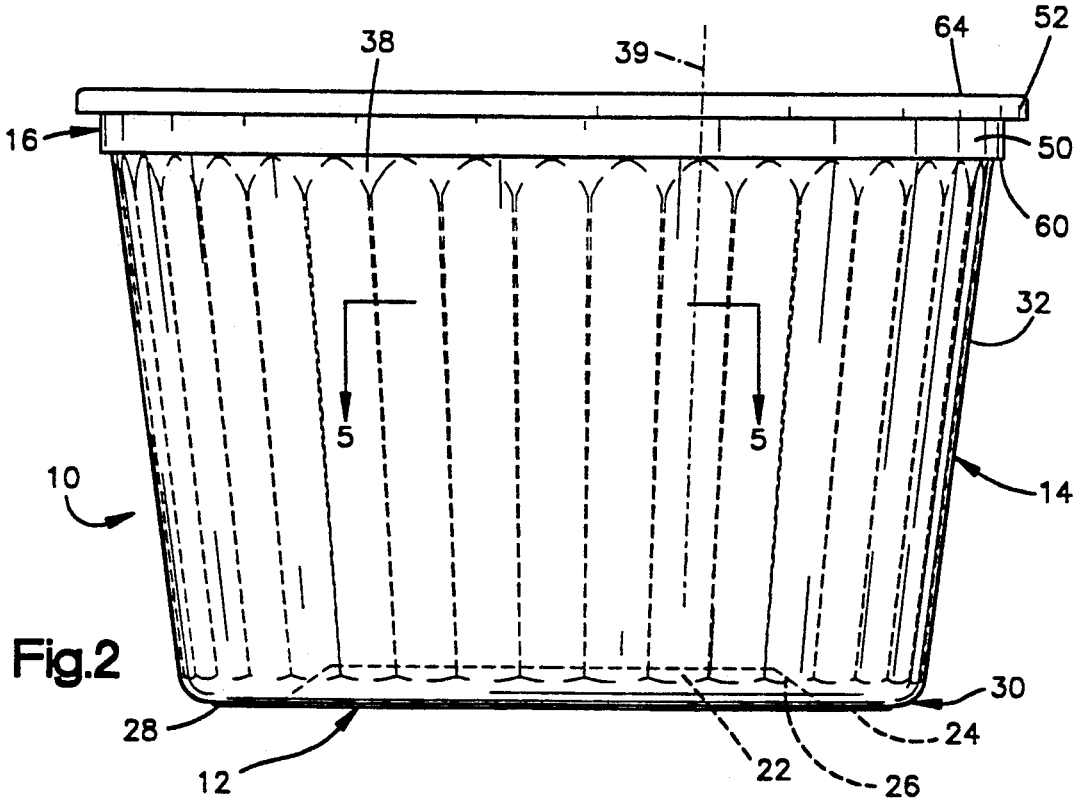
FIG. 2 is an elevational view of the container illustrated in FIG. 1.
Figure 3:
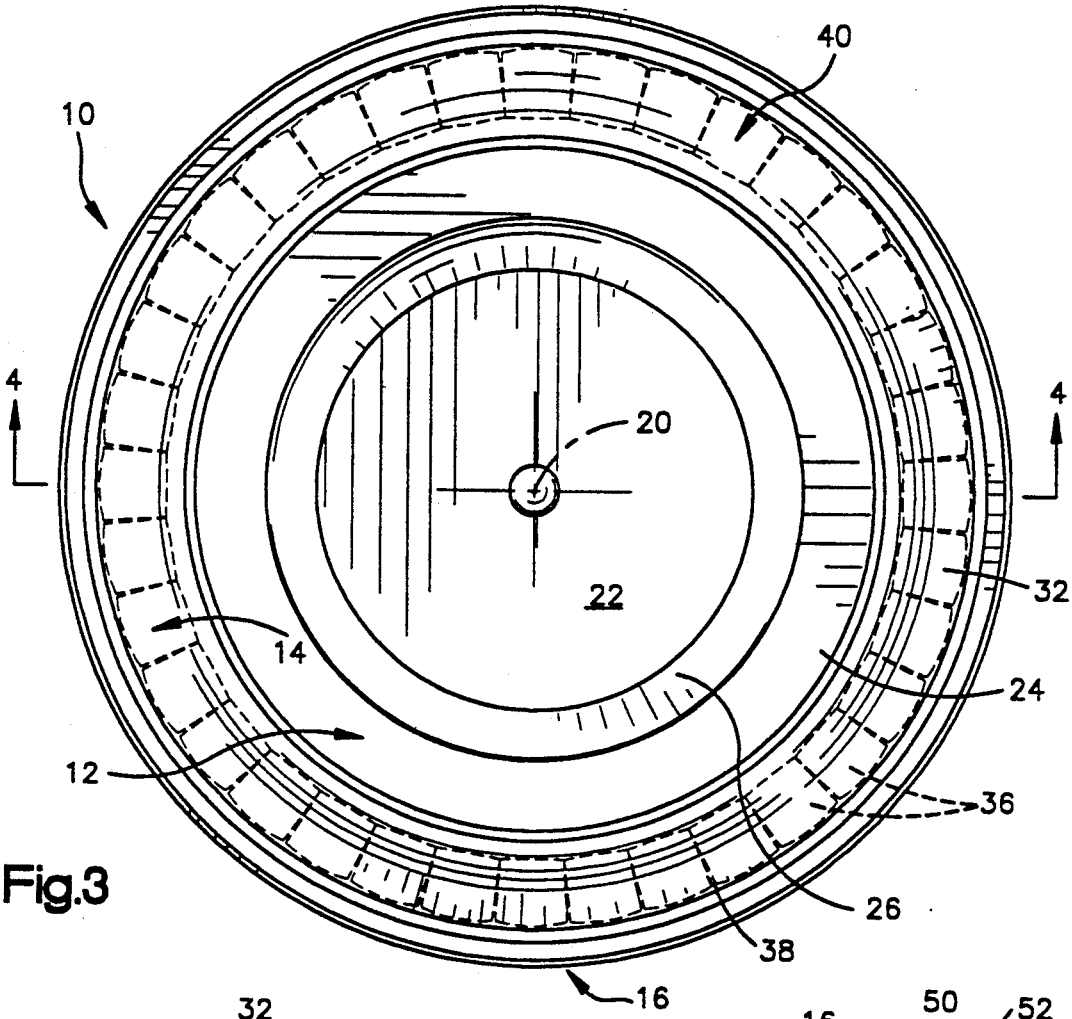
FIG. 3 is a bottom view of the container of FIG. 1.
Figure 4:
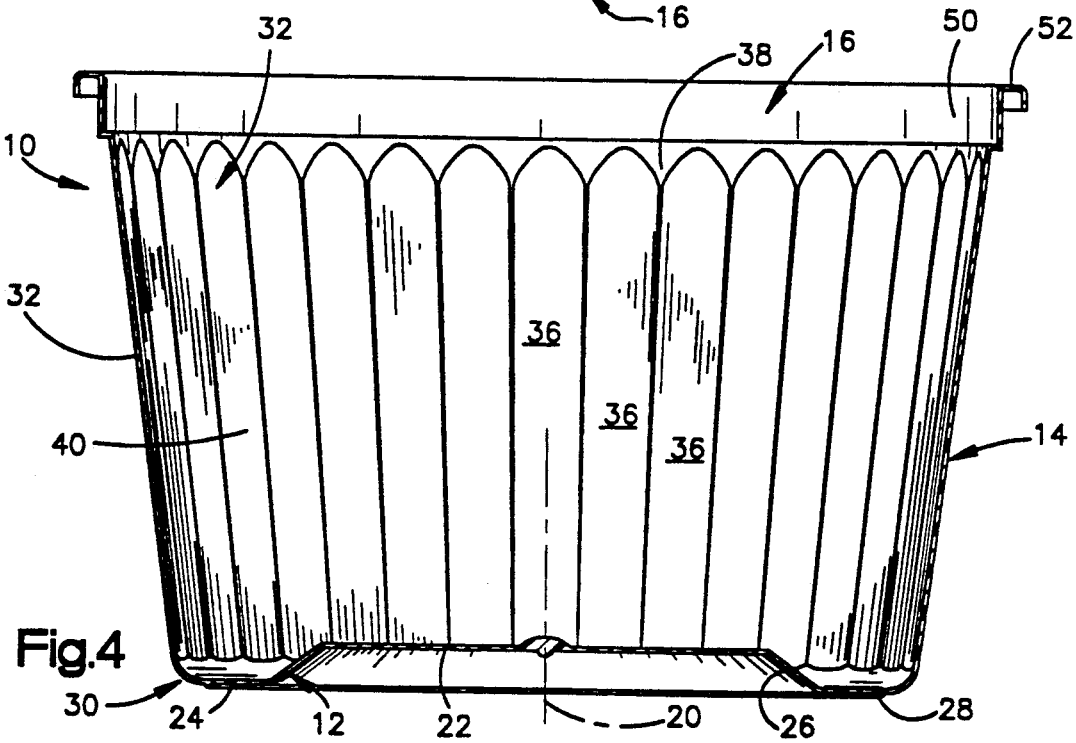
FIG. 4 is a cross sectional view seen approximately from the plane indicated by the line 4—4 of FIG. 3.

A preferred injection molded container constructed according to the invention is illustrated in the drawings. Referring to FIGS. 1-4 a container 10 is illustrated as comprising a bottom panel 12, a side wall 14 extending from the bottom panel, and lid receiving lip structure 16 extending about the projecting side wall end to define a container end opening 18 opposite the bottom panel 12. The side wall extends about a central axis 20 which extends centrally through the bottom panel 12 and the end opening 18.

The illustrated bottom panel 12 is generally circular and comprises a generally circular flat central section 22, an annular outer support section 24 surrounding the face 22 and a frustoconical stiffening ring section 26 connecting the sections 22, 24. The axis 20 forms the centerline of the panel sections 22, 24, and 26. A thin annular bead 28 of molded material, called a speed ring, projects from the support section 24. The container 10 rests on the speed ring, particularly during the packaging process when the container is being moved through conveyor systems and so forth. The speed ring 28 provides a small surface engagement between the container and the equipment to minimize any tendency of the container to "stick" to the conveyors or other parts of the machinery.

The side wall 14 is continuous with and joins the panel section 22 along an annular radiused chime-like region 30 disposed around the bottom of the container. The sidewall comprises a continuous outer wall surface 32 intersecting a plane extending normal to the axis 20 along a substantially circularly curved line and an inner wall surface 34 formed in part by a series of facets 36. The inner wall surface 34 intersects the plane normal to the axis 20 along a line having a substantially polygonal shape composed of straight line segments corresponding to respective facets 36 with each straight line segment extending tangent to a second substantially circular line within the first circular line.

The outer wall surface 32 is preferably frustoconical and diverges proceeding away from the panel 12 at a small cone angle. The smooth continuous outer surface is particularly well adapted for carrying images imprinted on the outer face by a suitable process carried out as the container 10 is manufactured.

The inner wall surface 34 extends parallel to the outer wall surface and thus diverges proceeding away from the panel 20 at a small included angle corresponding to the outer surface cone angle. The each facet 36 extends from adjacent the chime-like region 30 to the projecting end of the sidewall 14 remote from the panel 20. Each facet 36 is essentially contiguous with its neighboring facets at the region 30, i.e. the facet edges adjacent the chime-like section 30 abut or are at least closely adjacent. The facets diverge from each other slightly proceeding away from the region 30 so the adjacent facet edges diverge proceeding towards the remote sidewall end where they are preferably spaced apart only slightly. The container wall between the facet edges, where they are spaced apart, is quite thin and formed by parallel inner and outer container wall surface portions.

In the illustrated and preferred embodiment the facets 36 are substantially identical and form chord-like line segments within the circular line segment formed by the outer wall surface 32. The facets 36 are of consistent width proceeding along their longitudinal lengths so that a circular line, in a plane perpendicular to the axis 20, inscribed within the facets 36 and tangent to each facet is parallel to the circular line formed by the outer surface. The distance between the circular lines is the maximal container wall thickness Put another way, the maximal wall thickness is found on a radial line from the axis 20 through the longitudinal midline 39 of a facet 36 (see FIG. 5). The minimum container wall thickness extends between the inner and outer container wall surface portions. In the preferred embodiment 36 facets are formed within the container so each facet 36 corresponds to an outer container wall arc having a 10° included angle measured at the container axis 20.

Figure 5:
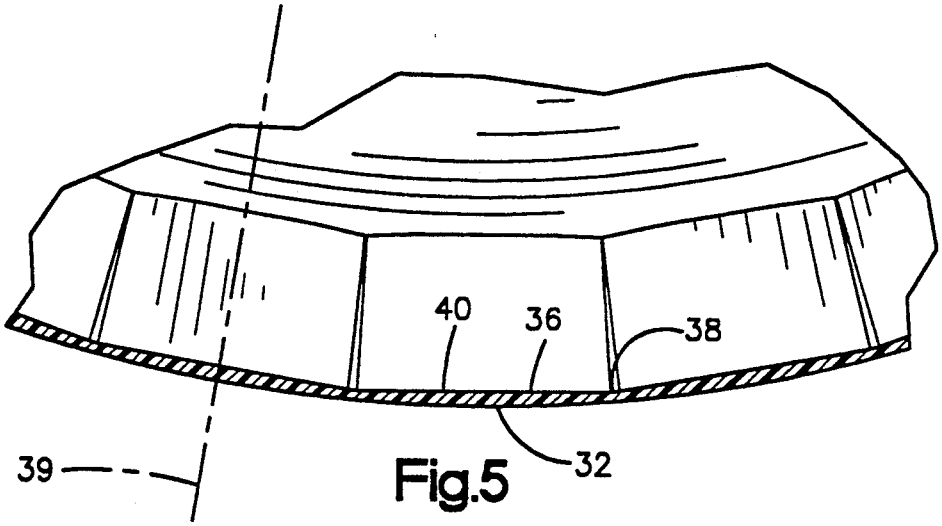
FIG. 5 is a cross sectional view seen approximately from the plane indicated by the line 5—5 of FIG. 2.
Figure 7:
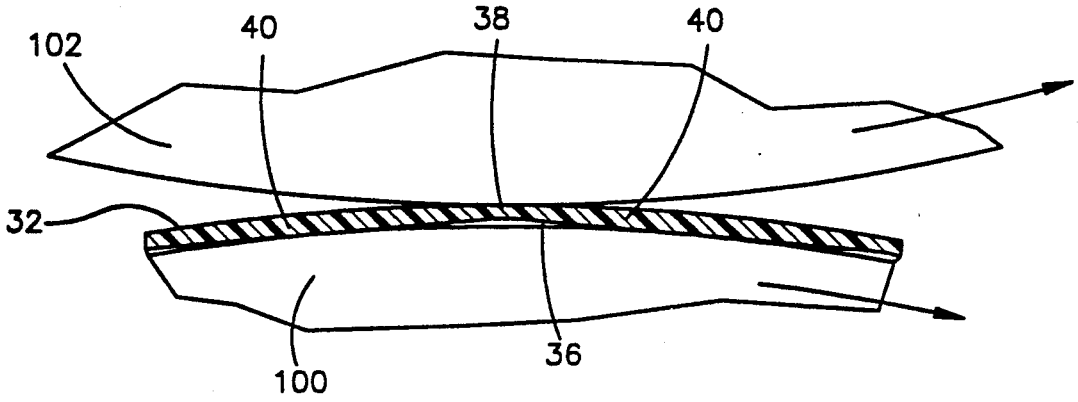
FIG. 7 is a view similar to that of FIG. 5 illustrating a container being printed on in an offset printing press; and, FIG. 8 is a fragmentary cross sectional view of a container rim structure and a container lid closing the container.

The side wall 14 comprises a series of spaced ribs 40 each defined between a respective facet 36 and the adjacent outer container wall surface. Each rib 40 has a maximal thickness equal to the container wall maximal thickness. As best seen in FIGS. 5 and 7 each rib 36 has a radially transverse cross sectional shape which is circularly curved on its outer side and straight on its inner side. The rib thus tapers from its maximum thickness proceeding toward the opposite rib edges.

The container side wall 14 also defines thin walled segments 38 between adjacent ribs 36. At the bottom panel location the segments 38 may simply correspond to the juncture of the adjacent rib edges while near the lip structure location the segments 38 are defined by the narrow spaces between the adjacent rib edges.

Each rib 36 has sufficient cross sectional area to assure injection molding material flow from the bottom panel area to the lip structure via the side wall. The controlling factor in assuring adequate molding material flow is the maximal thickness dimension of the ribs. This rib thickness must equal or exceed a predetermined dimension which depends upon the number and size of the mold cavities being filled. The ribs must also have sufficient column strength to enable mechanical capping of the container without collapsing the side wall. This strength requirement necessitates a rib thickness more than a predetermined minimum to provide adequate strength. In the illustrated and preferred embodiment of the invention the containers are molded in 16 cavity molds which maximizes their production rate while assuring adequate strength. The ribs are shaped to provide wide relatively low resistance flow paths for the molding material traversing the mold cavity.

Figure 8:
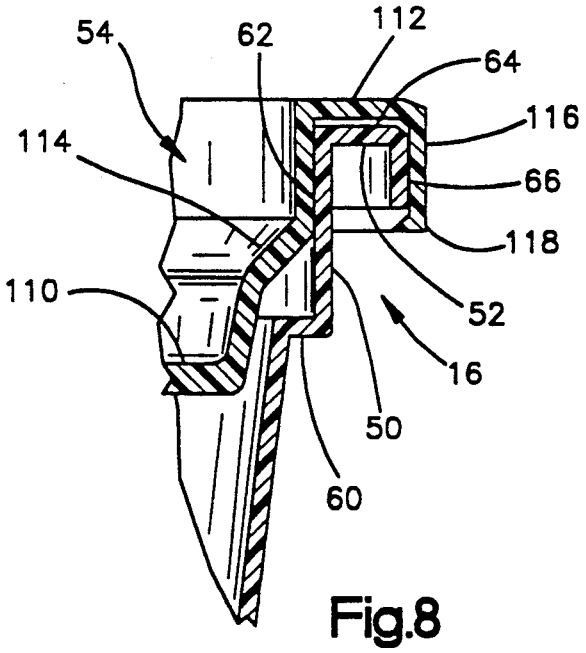

The lip structure 16 (FIGS. 1–4 and 8) is constructed and arranged for sealing and latching engagement with a lid applied to the container. The lip structure extends from the side wall 14 and comprises a sealing wall section 50 adjoining the side wall 14 and a latching rim section 52 adjoining the sealing wall section 50. FIG. 8 illustrates the lip structure 16 with a lid 54 in place on the container. The sealing wall section 50 comprises an annular shoulder 60 extending radially outwardly from the projecting end of the side wall 14 and a nearly cylindrical sealing wall 62 extending upwardly relative to the container from the shoulder 60. The sealing wall 62 is very slightly frustoconical, diverges upwardly and tightly receives a comporting wall of the lid. The latching rim section 52 is formed by an annular radially outwardly extending flange 64 which terminates in an axial latching skirt 66 extending from the outer perimeter of the flange 64 toward the bottom panel 12.

Figure 6:
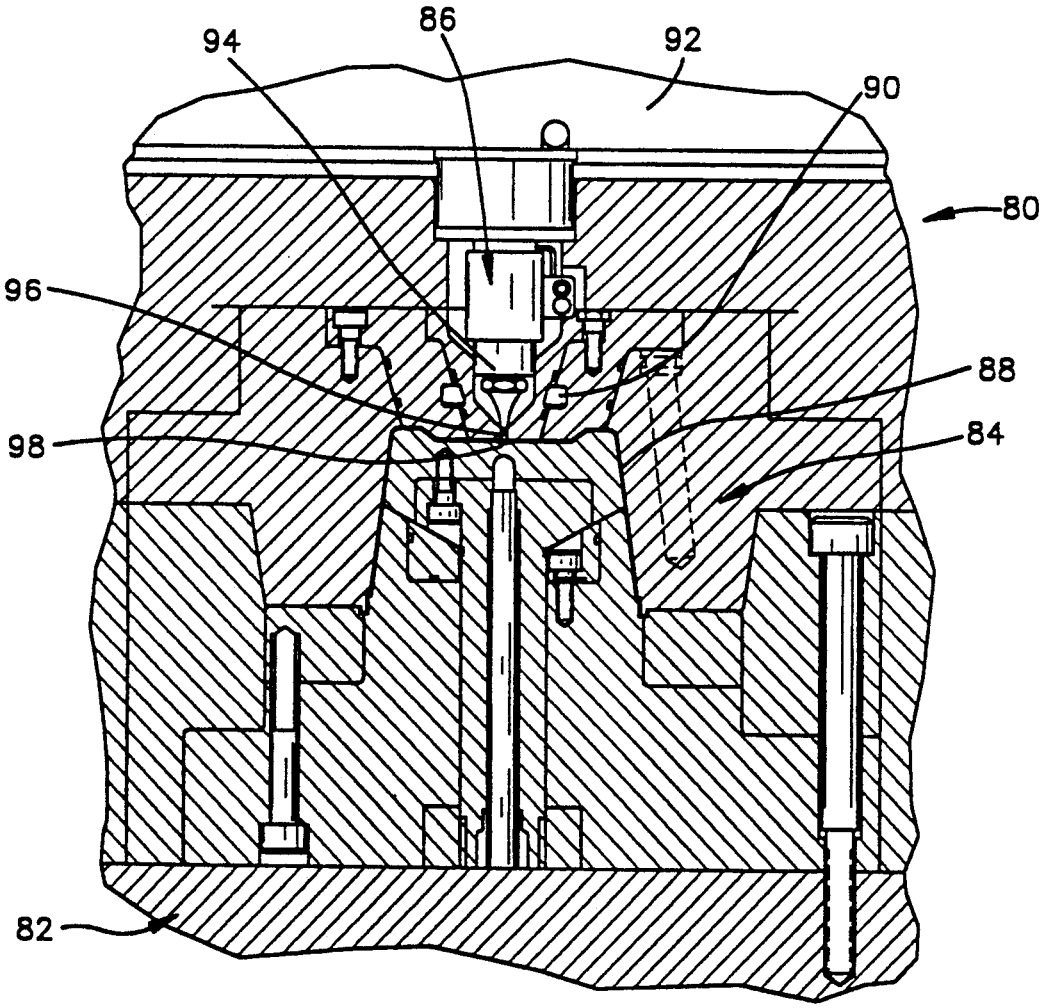
FIG. 6 is a cross sectional view of an injection molding cavity used to mold containers constructed according to the invention.

The container 10 is injection molded from a suitable plastic material, such as polypropylene. An example of part of a typical mold assembly 80 is illustrated by FIG. 6 of the drawings. The mold assembly 80 comprises a male mold unit 82, a female unit 84, and an injection structure 86 for directing liquid molding material into the cavity 88 defined between the units 82, 84. The female mold unit 84 is shaped like the outside of the container and the male mold unit 82 is shaped like the inside of the container, i.e. the male unit has a faceted exterior. The units 82, 84 are provided with coolant passages 90 so that plastic material which has been force flowed into the cavity 88 promptly "freezes" in the shape of the cavity as the heat in the plastic material is carried away by coolant flowing in the passages. The male unit 82 is associated with an actuator (not illustrated) for pulling the unit from the cavity 88 after a container has been molded. The molded container is stripped off of the male unit 82 and the unit moves back into position within the female mold unit 84 for molding the succeeding container.

The injection structure 86 may be of any conventional or suitable construction and comprises a molding material flow manifold 92, an injector nozzle 94 and a flow passage 96 leading from the nozzle into the portion of the cavity 88 corresponding to the center of the container bottom panel 12. Molten plastic molding material is forced to flow through the manifold 92 by a ram (not shown), through the injector nozzle 94 and into the cavity 88 via the passage 96. A shallow hemispherical recess 98 is formed in the cavity 88 in line with the passage 96 to facilitate high rate plastic flow into the cavity. The ram operates to flow the plastic material at high pressure so the material flows into the cavity extremely quickly.

It is essential that the molding material completely fill the cavity 88 before it "freezes." If the material freezes prematurely, material flow to part or all of the container lip structure portion of the mold cavity is blocked. The result is a defective container. Accordingly, the typical 16 cavity mold used for making the container 10 is constructed and arranged so that each cavity is filled in about 0.8 seconds.

The preferred container 10 is produced as a "family" of different sizes to accommodate the various products packaged in the container In the preferred family of containers 8, 12, 16, 24 and 32 fluid ounce sizes are molded. These containers have identical lip structure diameters at their upper ends (in the preferred container 4.650 in.). Each can be closed by an identical lid. The containers of each size differ in height and cone angle from containers of other sizes. As the container size decreases the height and bottom panel diameter decrease and the sidewall cone angle increases slightly.

The illustrated family of containers have the following overall dimensions (inches):

| Vol. angle | Height | Bottom dia. | Bottom thk. | Cone |
|---|---|---|---|---|
| 8 oz. | 1.704 | 3.776 | 0.019 | 18° |
| 12 oz. | 2.427 | 3.586 | 0.024 | 17° |
| 16 oz. | 3.000 | 3.538 | 0.024 | 15° |
| 24 oz. | 4.690 | 3.183 | 0.028 | 14° |
| 32 oz. | 3.469 | 3.469 | 0.032 | 9° |

An important factor in designing injection molded containers is maintenance of a ratio between the thickness of container side wall and the length of travel of the molding material from its point of entry into the mold cavity to the farthest cavity location. This ratio is referred to as the "L/T ratio." In the preferred container 10 the length dimension of the L/T ratio is determined by the distance traversed by the molding material travelling from the center of the bottom panel directly to the depending edge of the lip structure.

In a container having a uniformly thick sidewall, if the L/T ratio is low, e.g. less than about 220, the container wall tends to be excessively thick, resulting in the container being heavier than necessary and using excessive molding material. If the L/T ratio for a uniform wall container is too high, e.g. over 300, the container wall is too thin. This can result in defective containers due to molding flow blockage and incomplete molding Further, these containers tend to collapse during the capping process because the sidewalls are excessively weak.

The present invention provides a new and improved container construction where the sidewall is of nonuniform thickness to enable high effective molding material flow rates through the mold cavity and attendant high sidewall column strengths while minimizing the weight and amount of molding material required to fabricate the containers particularly when the containers are being "shot" in 16 cavity molds. With the new container configuration there are two L/T ratios for each container The facets on the sidewall interior provide an L/T ratio which is relatively low to assure that the cavity fills adequately and the sidewall column strength is high. The thickness of the sidewall for purposes of determining the ratio is the sidewall thickness at the longitudinal facet midline 39.

The container wall thickness at the facet junctures provides a relatively high L/T ratio which is sufficient to assure molding material flow completely through the facet junctures while minimizing the container weight and quantity of material required to form the container.

The family of containers disclosed preferably exhibit the following L/T ratios.

| Size (oz.) | Max. L/T | Min. L/T | Max. T. (in.) | Min. T (in.) |
|---|---|---|---|---|
| 8 | 348 | 225 | 0.017 | 0.011 |
| 12 | 376 | 250 | 0.018 | 0.012 |
| 16 | 418 | 278 | 0.018 | 0.012 |

-continued

| Size (oz.) | Max. L/T | Min. L/T | Max. T. (in.) | Min. T (in.) |
|---|---|---|---|---|
| 24 | 338 | 250 | 0.026 | 0.020 |
| 32 | 373 | 287 | 0.026 | 0.020 |

It has been found that maintaining the low L/T ratios of the faceted containers within the range from about 225 to 290 and the high L/T ratios within the range from about 330 to 420 produces containers which are defect free, adequately strong for capping and yet are highly efficient in terms of low weight and low material costs. The maximum and minimum L/T ratios referred to are particularly critical when the containers are made using 16 cavity molds which enjoy a higher production rate of containers than molds having fewer cavities.

Another important aspect of the new container design is the ease with which it can be printed on even though the sidewall is not uniformly thick. During the manufacturing process the containers 10 may be provided with an image which is printed on the outer container face in an offset lithographic printing press (see FIG. 7). Each container is supported on a frustoconical mandrel 100 which matches the internal cone angle of the container it supports. The mandrel has a diametral size selected so that it is tangent to and engages the longitudinal midline of each facet in the container (see FIG. 7).

The mandrel 100 is rotatable about the central container axis 20. The mandrel supports the smooth frustoconical outer sidewall face 32 for rotational movement into engagement with an offset press blanket roll 102 so an image is transferred to the container from the blanket roll. The blanket roll 102 is of conventional construction and has a relatively soft resilient blanket member on its periphery which carries an image formed by ink deposited on the blanket. The surface speeds of the blanket roll and the container outer face are identical so that the blanket roll 102, which has a considerably larger diameter than the container 10, progressively engages the outer periphery of the container as the ink image is transferred to the container from the blanket.

The ribs 36 react with the mandrel 100 and the blanket roll 102 to provide a cantilever-like spring support for the thin walled segments 38 between the ribs 36. During the offset printing process the blanket roll 102 engages the container outer wall and exerts force on the ribs 40 tending to deflect the thin walled segments 38 away from contact with the blanket roll Loss of contact with the blanket roll prevents transferring the print image. The ribs 36 react in a cantilever fashion to resiliently resist thin walled segment deflection and urge the segments 38 toward engagement with the blanket roll. The structure of the container 10 functions to maintain image transferring pressure between the blanket roll 102 and the container outer wall so the resultant image is uniform in appearance and is not discontinuous.

The mandrel 100 thus does not need to be provided with facets on its outer face to support the container 10 during printing. Consequently, the mandrel and container need not be specially registered prior to printing. A registration step would materially slow the printing process and increase the cost of manufacture accordingly.

Printed containers and lids are delivered to a packaging location where the containers are filled with product and capped for shipment to market. As noted previously, all the containers have the same top dimensions so that each can be capped with a common lid construction. FIG. 8 illustrates the relationship between a container 10 and a lid 54. The lid 54 has a central closure section 110, a peripheral rim structure 112 and a conical clearance ring 114 between the rim structure and the closure section. The rim structure 112 snugly fits against the container sealing wall 62 to seal the container closed and has an outer latching skirt 116 terminating in a peripheral bead 118 which latches to the container skirt 66 when the lid caps the container.

The lid 54 is forced onto the container by capping machinery, not illustrated. Containers and their contents are fed along a conveyor to a capping station where a lid is aligned with the open top end of the container and forced into its position illustrated by FIG. 8. This operation necessarily involves exerting downward forces on the container sidewalls. The sidewalls must exhibit sufficient column strength to resist collapsing in the capping process. The ribs 36, because of their number, positioning within the container and their cross sectional shape, stiffen the sidewall sufficiently so it does not collapse even though the thin walled segments 38 are not sufficiently strong to resist the capping forces in and of themselves. While a single preferred embodiment of a container embodying the present invention is illustrated and described herein in considerable detail the invention is not to be considered limited to the precise construction disclosed. Various adaptations, modifications and uses of the invention may occur to those skilled in the art to which the invention relates. The intention is to cover all such adaptations, modifications and uses which fall within the spirit or scope of the appended claims.

Having described my invention, I claim:

1. An injection molded container having a bottom panel, a side wall extending from said bottom panel, and lid receiving lip structure extending about the projecting wall end defining an end opening opposite the bottom panel, said side wall extending about a central axis through the bottom panel and end opening and comprising:

a continuous outer wall face intersecting a plane extending normal to said axis along a substantially circularly curved line; an inner wall surface defined by a series of facets, said inner wall face intersecting said plane along a line having a substantially polygonal shape;

said polygonal shape composed of straight line segments corresponding to respective ones of said facets with each straight line segment defining the chord of a second circular line within said first circular line;

said side wall defining a series of spaced load supporting ribs respectively defined between a respective facet and the outer face, each rib having a maximal thickness radially outwardly from the midpoint the respective straight line segment, a series of thin walled segments having a minimal thickness along a radial line extending between adjacent ends of adjacent straight line segments;

the maximal thickness rib having sufficient column strength to enable mechanical capping of the container.

2. An injection molded container formed by a continuous wall comprising a generally circular bottom panel, a side wall portion extending from said bottom panel, and lid receiving lip structure extending about the projecting side wall portion end, said lip structure having a marginal edge remote from said sidewall and defining a container end opening opposite the bottom panel, said side wall and lip structure extending about a central axis through the bottom panel and end opening, said side wall portion comprising:

a smooth frustoconical outer face disposed between said panel and said lip structure, said outer face diverging away from said panel at a small cone angle;

an inner surface defined in part by a series of planar facets each disposed between said panel and said lip structure, each facet contained within a 10 arc centered on said central axis and each facet extending longitudinally along said sidewall substantially between the bottom panel and the lip structure;

said planar facets defining a maximal sidewall thickness along their longitudinal midlines and a minimal sidewall thickness between adjacent facet edges; and, the ratio of the shortest distance between the intersection of the central axis with the bottom panel and the lip structure marginal edge to the minimal sidewall thickness being between about 330–420.

* * * * *